US007608478B2

(12) United States Patent
Gangopadhyay et al.

(10) Patent No.: US 7,608,478 B2
(45) Date of Patent: Oct. 27, 2009

(54) ON-CHIP IGNITER AND METHOD OF MANUFACTURE

(75) Inventors: Shubhra Gangopadhyay, Columbia, MO (US); Rajesh Shende, Columbia, MO (US); Steve Apperson, Columbia, MO (US); Shantanu Bhattacharya, Columbia, MO (US); Yuanfang Gao, Columbia, MO (US)

(73) Assignee: The Curators of the University of Missouri, Columbia, MO (US)

( * ) Notice: Subject to any disclaimer, the term of this patent is extended or adjusted under 35 U.S.C. 154(b) by 442 days.

(21) Appl. No.: 11/261,831

(22) Filed: Oct. 28, 2005

(65) Prior Publication Data

US 2007/0099335 A1 May 3, 2007

(51) Int. Cl.
*H01L 21/44* (2006.01)

(52) U.S. Cl. ..... 438/106

(58) Field of Classification Search ..... None
See application file for complete search history.

(56) References Cited

U.S. PATENT DOCUMENTS

| | | | |
|---|---|---|---|
| 6,199,484 | B1 | 3/2001 | Martinez-Tovar |
| 6,298,784 | B1 | 10/2001 | Knowlton |
| 6,517,802 | B1 | 2/2003 | Xiao et al. |
| 6,539,869 | B2 | 4/2003 | Knowlton |
| 6,712,917 | B2 | 3/2004 | Gash et al. |
| 6,733,828 | B2 | 5/2004 | Chao et al. |
| 6,740,403 | B2 | 5/2004 | Gogotsi et al. |
| 6,818,081 | B2 | 11/2004 | Gash et al. |
| 6,818,344 | B2 | 11/2004 | Daoud |
| 6,923,946 | B2 | 8/2005 | Geohegan et al. |
| 6,962,634 | B2 | 11/2005 | Nielson |
| 6,986,819 | B2 | 1/2006 | Tillotson et al. |
| 7,025,840 | B1 | 4/2006 | Adams |
| 7,192,649 | B1 | 3/2007 | Jouet et al. |
| 2003/0096897 | A1 | 5/2003 | Nielson et al. |
| 2003/0108683 | A1 | 6/2003 | Wu |
| 2003/0145924 | A1 | 8/2003 | Carter, Jr. |
| 2004/0005723 | A1 | 1/2004 | Empedocles et al. |
| 2004/0056458 | A1 | 3/2004 | Daoud |
| 2004/0203071 | A1 * | 10/2004 | Chase et al. ..... 435/7.1 |
| 2005/0189053 | A1 | 9/2005 | Pile et al. |
| 2005/0216075 | A1 * | 9/2005 | Wang et al. ..... 623/1.15 |
| 2006/0236887 | A1 * | 10/2006 | Childs et al. ..... 102/272 |

OTHER PUBLICATIONS

Rama Venkatasubramanian, Edward Siivola, Thomas Colpitts & Brooks O'Quinn "Thin-film thermoelectric devices with high room-temperature figures of merit" Nature vol. 413, 2001, 597-602.

(Continued)

*Primary Examiner*—Charles D. Garber
*Assistant Examiner*—Andre' C Stevenson
(74) *Attorney, Agent, or Firm*—Greer, Burns & Crain, Ltd.

(57) ABSTRACT

A chip for igniting nanoenergetic materials, includes a substrate, an igniter positioned on the substrate and the nanoenergetic material arranged in a linear pattern positioned on said substrate. A method of making a chip for igniting nanoenergetic materials includes providing a substrate, forming an igniter on the substrate and coating the substrate with a polymer layer. A pattern of nanoenergetic material comprising a fuel and an oxidizer is formed on the substrate. The nanoenergetic material is ignited by the igniter by supplying power to the leads attached to the heater film.

14 Claims, 4 Drawing Sheets

OTHER PUBLICATIONS

C. Greaves, "The direct conversion of heat into electricity Thermoelectric conversion and thermionic conversion" Physics Education, 1968, vol. 3 Printed in Great Britain, 330-337.
P.L. Hagelstein, Y. Kucherov, "Enhancement of Thermal to Electrical Energy Conversion with Thermal Diodes", Mat Res. Soc. Symp. Proc. vol. 691, 2002 Materials Research Society. G8.37.1-G837.6.
P.L. Hagelstein, Y. Kucherov, "Enhanced figure of merit in thermal to electrical energy conversion using diode structures", Appl. Phys. Lett. vol. 81, 2002, 559-561.
Gavens, A.J., Heerden, D.V., Mann A.B., Reiss, M.E., Weihs, T.P., "Effect of intermixing on self propagating exothermic reactions in Al/Ni nanolaminate foils", Journal of Applied Physics, 87(3) (2000) 1255-1263.
Trott W.M., Erricson, K.L., Ultra highspeed studies of shock phenomenon in a miniaturized system—A preliminary evaluation, Sandia National Laboratories, Albuquerque, New Mexico 87185.
Technical Discussion in website http://www.risi-usa.com, 2000.
Deeds, M., Sandborn P., Swaminathan R., "Packaging of MEMS based safety and arming device", IEEE Proceedings of the intersociety conference on thermal phenomena, 2000, pp. 107-112.
Paul Redner, Steven Nicolich, Shybhra Gangopadhyay and Rajesh Shende, "The Development of Energetic Nanocomposites for the Warfighter", Particle Technology Forum, The 2005 Annual Meeting (Cincinnati, OH), Nov. 3, 2005.
Takayama, K., Saito, T. "Shock Wave/Geophysical and Medical Applications", Annual Review of Fluid Mechanics, 36 (2004) 347-49.
Malynych, Luzinow I., Chumanov G. "Poly (vinyl pyridine) as a universal surface modifier for immobilization of nanoparticles", J. Phys. Chem. B 106 (2002), 1280-85.
Baer, M.R., Kipp, M.E. and Swov, F.V., "Micromechanical modeling of heterogeneous materials", Sandia National Laboratories, Albuquerque, New Mexico 87185.
Stewart D.S., "Miniaturization of explosive technology and microdetonics", XXIICTAM, Aug. 15-21, 2004, Warsaw, Poland.
Bowden, F.P. And Yoffe, A.D., "Initiation and growth of explosions in liquids and solids", Cambridge University press, Cambridge, 1952.
Sheffield, S.A., Gustaven, R.L., Alcon, R.R., Graham, R.A. and Anderson, M.U., "Particle velocity and stress measurements in low density HMX," High pressure Science and Technology (1994) 1377-80.
Stephen D. Senturia, "Microsystem Design", Kluwer Academic Publishers, Boston/Dordrecht /London.
H.M. Mott-Smith, Irving Langmuir, "The theory of collectors in gaseous discharges", Physical Review, Oct. 1926, V.28, 727-763.
Kaili Zhang, Chou, S.K.; Ang, S.S., "MEMS-based solid propellant microthruster design, simulation, fabrication, and testing", Journal of Microelectromechanical Systems, vol. 13, Issue: 2, Apr. 2004, pp. 165-175.
Lewis, D.H., Jr.; Janson, S.W.; Cohen, R.B.; Antonsson, EK, "Digital MicroPropulsion", The Aerospace Corporation, California Institute of Technology, pp. 517-522.
A.G. Merzhanov, "The Chemistry of Self-Propagating High Temperature Synthesis," J. Mater. Chem. 14 (2004) 1779-1786.
Merzhanov, A.G. 1990. Combustion and Plasma Synthesis of High Temperature Materials, edited by Munir, Z.A. and Holt, J.B. New York:VCH.
Munir, Z.A. and Anselmi-Tamburini "Self-Propagating Exothermic Reactions: The Synthesis of High-Temperature Materials by Compustion" (1989) 277-365.
Moore, J.J. and Feng H.J. "Combustion Synthesis of Advanced Materials: Part I. Reaction Paramters" Prog. Mater. Sci. 39 (1995) 243-273.
Moore, J.J. and Feng H.J. "Exothermic Reaction Synthesis", 295-311. Syntheis/Processing of Lightweight Metallic Materials Edited by F.H. Froes, C. Suryanarayana, and C.M. Ward—Close the Minerals, Metals & Materials Society, 1995.
S.A. Davis, S.L. Burkkett, N.H. Mendeison and S. Mann, "Bacterial templating of ordered macrostructures in silica and silica-surfactant mesophases", Nature, 1997, 385, 420-423.
H.-P. Lin, S. Cheng and C.-Y. Mou, "Mesoporous Molecular Sieves MCM-41 with a Hollow Tubular Morphology", 10, 1998, 581-589.
X. Yang, S. Chen, S. Zhao, D. Li, and H. Houyma. "Synthesis of copper nanorods using electrochemical methods" J Serb. Chem. Soc. 68 (11) (2003) 843-847.
Y.Y. Fu, R.M. Wang, J. Xu, J. Chen, Y. Yan, A.V. Narlikar, H. Zhang, "Synthesis of Large Arrays of Aligned a-$Fe_2O_3$ Nanowires", Chemical Physics Letters 379 (2003) 373-379.
Serhiy Malynych, Igor Luzinov, and George Chumanov, "Poly(Vinyl Pyridine) as a universal surface modifier for immobilization of nanoparticles" J. Phys. Chem. B 2002 106, 1280-1285.
Newkome, G.R.; Woosley, B.D.; He, E.,; Moorefield, C.D.; Guter, R.; Baker, G.R.; Escamilla, G.H.; Merrill, J. ; Luftmann, H. "Supramolecular chemistry of flexible, dendritic-based structures employing molecular recognition" Chem. Commun. 1996, 2737-2738.
Newkome, G.R.; He, E.; Moorefield, C.N., "Suprasupermolecules with Novel Properties:Metallodendrimers" Chem. Rev. 99 (1999) 1689-1746.
Narayan K. Raman, Mark T. Anderson, and C. Jeffrey Brinker, "Template-Based Approaches to the Preparation of Amorphous, Nanoporous Silicas" Chem. Mater. 8 (1996) 1682-1701.
T. Kang, Y. Park, K. Choi, J.S. Lee, and J. Yi, "Ordered mesorporous silica (SBA-15) dramatized with imidazole-containing functionalities as a selective absorbent of precious metal ions", J. Mater. Chem., 14 (2004) 1043-49.
Clapsaddle, B.J.; A.E. Gash, K.B. Plantier, M.L. Pantoya, J.H. Satcher, Jr., R.L. Simpson, "Synthesis and Characterization of Mixed Metal Oxide Nanocomposite Energetic Materials", *Proceedings of the 31st International Pyrotechnics Seminar*, May 12, 2004.
Gash et al., "Nanostructured Energetic Materials with Sol-Gel Methods" Materials Research Society, Fall 2003 Meeting, Nov. 26, 2003.
Granier, John J; Michelle L. Pantoya, "Laser Ignition of Nanocomposite Thermites", *Combustion and Flame*, vol. 138, 2004, pp. 373-383.
Kim, Soo H.; Michael R. Zachariah, "Enhancing the Rate of Energy Release from NanoEnergetic Materials by Electrostatically Enhanced Assembly", *Advanced Materials*, vol. 16, No. 20, Oct. 18, 2004, pp. 1821-1825.
Kliche, G.; et al., "Far-infrared spectroscopic investigations on CuO", *Physical Review*, vol. 42, No. 16, Dec. 1, 1990, pp. 10060-10066.
J.J. Moore et al., "Exothermic Reaction Synthesis", *Synthesis/Processing of Lightweight Metallic Materials*, 1995, pp. 295-311.
C.Y. Mou et al., "Control of Morphology in Synthesizing Mesoporous Silica", *Pure Appl. Chem.* vol. 72, Nos. 1-2, 2000, pp. 137-146.
Music, S.; S. Krehula, S. Popovic, "Thermal Decomposition of β-FeOOH", *Materials Letters*, vol. 58, 2004, pp. 444-448.
Prakash, Anand et al., Synthesis and Reactivity of a Super-Reactive Metastable Intermolecular Composite Formulation of $A1/KM_nO_4$, Adv. Mater. 2005, 17, No. 7, Apr. 4.
Tripkovic, Amalija V. et al., "Comparison of formic acid oxidation at supported Pt catalyst and at low-index Pt single crystal electrodes insulfuric acid solution", *J. Serb. Chem. Soc.*, vol. 68, No. 11, 2003, pp. 849-857.
Vayssieres, Lionel; Corrine Chaneac, Elisabeth Tronc, Jean Pierre Jolivet, "Size Tailoring of Magnetite Particles Formed by Aqueous Precipitation: An Example of Thermodynamic Stability of Nanometric Oxide Particles", *Journal of Colloid and Interface Science*, vol. 205, 1998, pp. 205-212.
Vayssieres, Lionel; Anders Hagfeldt, Sten Eric Lindquist, "Purpose-Built Metal Oxide Nanomaterials. The Emergence of a New Generation of Smart Materials", *Pure Appl. Chem.*, vol. 72, No. 1, 2000, pp. 47-52.
Vayssieres, Lionel; et al., "Controlled Aqueous Chemical Growth of Oriented Three-Dimensional Crystalline Nanorod Arrays: Application to Iron (III) Oxides", *Chemistry of Materials*, vol. 13, No. 2, Feb. 2001, pp. 233-235.
Vayssieres, Lionel;, et al., "Purpose-Built Anisotropic Metal Oxide Material: 3D Highly Oriented Microrod Array of ZnO", *J. Phys. Chem.*, B vol. 105, No. 17, 2001, pp. 3350-3352.
Vayssieres, Lionel; "Aqueous purpose-built nanostructured metal oxide thin films", *Int. J. of Material & Product Technology*, vol. 18, Nos. 4/5/6, 2003, pp. 313-337.
Mehendale, Bhushan J., "Synethsis of Ordered Nanoenergetic Composites", pp. 1-81, May 2005.

* cited by examiner

ON-CHIP IGNITER AND METHOD OF MANUFACTURE

CROSS REFERENCE TO RELATED APPLICATION

This application is related to U.S. Ser. No. 11/262,227, entitled, "Ordered Nanoenergetic Composites and Synthesis Method," filed concurrently herewith and herein incorporated by reference.

FIELD OF THE INVENTION

This application relates to a chip for igniting nanoenergetic materials. More specifically, nanoenergetic materials are arranged in a pattern on the chip that includes an ingiter. The chip has many uses, including a diagnostic tool, a fuse, a power generator, a microthruster, detonators, igniter for explosives, igniter for propellans and for low temperature crystallization of thin films.

BACKGROUND

Nano-energetic materials are mixtures of fuel and oxidizers closely packed together for a self-sustaining, high temperature reaction. Tiny particles have increased surface area over larger particles. Close proximity of the fuel and the oxidizer create waves of energy as the flame propagates through the solid material. Energy from adjacent layers ignites the fuel/oxidizer mixture. Material can be used as prepared or modified with polymers or explosives and used as a primers for explosives or propellants. Materials of this type have potential application in mining, demolitions, precision cutting, explosive welding, surface treatment and hardening of materials, pulse owner, crystallization and solar cells, sintering, micro-aerospace, satellite platforms, military applications and biomedical fields that destroy localized pathological tissues. Other prominent applications include thermite torches for underwater and atmospheric cutting or perforation, electronic hardware devices, additives to propellants and explosives having increased performance, pyrotechnic switches, airbag gas generator materials, high-temperature stable igniters, freestanding insertable heat sources, devices to breach ordnance cases to relieve pressure during fuel fires, thermal battery heat sources, incendiary projectiles, delay fuses, additives to propellants to increase burn rate without decrease of specific impulse and full sized shape-charged liners.

There are a few types of on-chip ignition devices such as exploding bridge-wires ("EBW") and exploding foil initiators ("EFI"). The EBW and EFI devices are electro-shock initiated devices. These types of devices have fast and repeatable function times. They also have a high resistance to accidental initiation. However, EBW devices, such as the tungsten bridge, when supplied with current, causes plasma to form which vaporizes the tungsten and causes the ignition of the energetic material. EBWs also take the form of a semiconductor bridge, which operates in a similar manner. It produces plasma when current flows which then vaporizes the bridge material. These devices are fabricated on silicon, sapphire, or silicon-on-sapphire substrates. They are capable of initiation with energies below 100 mJ.

A common method for the ignition of nano-thermites is by laser heating. With laser powers of 50 W, or 100 W/cm2 such thermites have been ignited in 21 ms. Such setups are very large and expensive.

There are many types of thin-film resistive heaters in use at the present time. Thin-film platinum heaters are used where surface heating is necessary. They have been used for crystallization of ceramic films, and for sensor reactivation. They have also been used to melt solder for the attachment of optoelectronic components to substrates.

There is a need for low power and low cost ignitors (initiators) for many applications mentioned above. These ignitors should be inexpensive and convenient and easy and safe to handle. They can be fabricated for controlling the ignition delay and tailor the properties of energetic material and heater for specific applications.

As the materials to be detonated become more sophisticated, the flame propagation speed and the propagation of the flame front become faster, and materials to test them must adapt accordingly. For the applications cited above, it is important to have a thorough knowledge of the ignition characteristics of nanoenergetics materials. Available methods for testing are also expensive. Some test methods require high-end digital imaging systems. Testing devices that are unable to distinguish new products from each other are useless for screening new products. Large-scale testing systems are not always available for investigation or rare, expensive or highly toxic statistical analysis or small labs on limited budgets.

Several diagnostic methods are used to study ignition characteristics of nanoenergetic materials. Some of these mechanisms include shock loading, electric exploding foil accelerators, light-ion-beam driver for flyer plate acceleration and indirect irradiation of the target material with a high-intensity pulsed laser. Some of the prior art literature mentions multi-metal foils, typically aluminum or nickel. The flame velocity is then measured by sputtering metal bilayer on a polished silicon substrate and then separating the film from the surface and taping the free standing bimetallic multilayered foil (obtained by cleaving the silicon substrate and carefully peeling off) over another substrate for structural stability.

These methods are very expensive and some require installation of high-speed digital imaging systems. Initiation of the reaction is by localized heating and detection of flame using an array of optical fibers. This method requires an oscilloscope or other expensive optical set up. Each of these methods offers advantages but also significant limitations. The direct laser technique requires extensive tailoring of the laser temporal and spatial profile to avoid the production of ill-conditioned shock waves. The light-ion-beam and radiation drivers generally do not permit rapid turn around. Other characterization techniques use expensive high-speed movie cameras. Moreover, these large-scale systems are impractical for investigation of rare, expensive or highly toxic materials.

SUMMARY OF THE INVENTION

These and other needs are satisfied by a system and method of making it that includes an on-chip system that can be used to ignite nanoenergetic materials. The combination of the on-chip heater and patterned energetic material can be used as a low power initiator for energetic materials such as pyrotechnics, explosives and propellants.

More specifically, a chip for igniting nanoenergetic materials, includes a substrate, an igniter positioned on the substrate and the nanoenergetic material arranged in a pattern positioned on said substrate. A method of making a chip for igniting nanoenergetic materials includes providing a substrate, forming an igniter on the substrate and coating the substrate with a polymer layer. A pattern of nanoenergetic material comprising a fuel and an oxidizer is formed on the substrate. The nanoenergetic material is ignited by the heater powered by leads attached to the chip.

In a preferred embodiment, the nanoenergetic materials can also be filled in microchannels or microwells fabricated in the substrate The microchannels or microwells can create confined environment for the energetic propagation and produce strong shock waves or detonation on a chip. There are many applications of microdetonators and micro shock generation systems.

The chip is inexpensive and can be built on the substrate less than 3 inches in size. Common materials are used in the manufacture of the chip, assuring the availability of the necessary components and maintaining a reasonable cost. No additional labor is needed to run complex equipment, such as high-speed digital cameras.

This apparatus also provides an easy and safe way of handling nanoenergetic materials. The amount of combustible material on any single device is very small, reducing the probability of damage if the nanoenergetic material is ignited by accident. Since the nanoenergetic material is fixed to the surface of the substrate, it is unlikely to spill or contaminate other products, and is much easier to handle compared to loose fine powders or particles.

In one embodiment of this invention, properties of nanoenergetic materials can be diagnosed using the chip to which a time-varying resistor detector is added, and measuring the flame propagation velocity by the time for the flame front to travel a given linear distance. The chip is also useful as a fuse for explosives, particularly when a wireless signal receiver is added to the chip. Power can be generated by the chip, and can be used to recharge a capacitor when the power from multiple devices is accumulated.

DETAILED DESCRIPTION OF THE DRAWINGS

DETAILED DESCRIPTION OF THE INVENTION

There is a need in the art for a low cost screening tool for studying nanoenergetic materials. The tool should be disposable and very inexpensive. There are opportunities for designing such a tool to produce accurate and straightforward results. It should not require expensive equipment with which to operate the tool. Operator information should be minimized to reduce labor costs. Finally, the tool should be adaptable to a variety of purposes.

Figure 1:
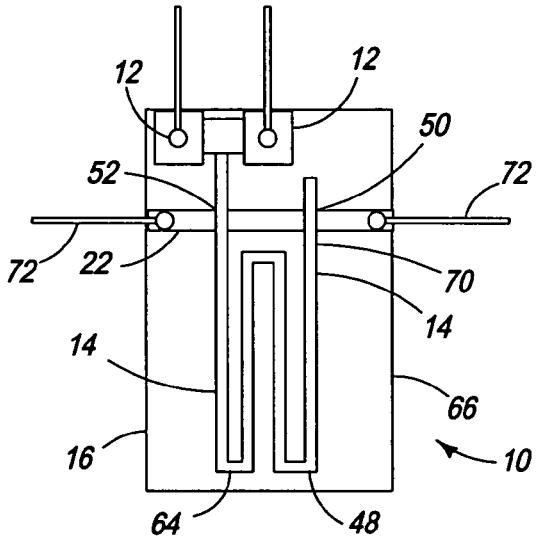
FIG. 1 is a schematic design of a chip for igniting nanoenergetics.

Referring to FIG. 1, a chip, generally 10, having an onboard igniter or heater 12 to ignite a nanoenergetic material 14 on a substrate 16 and a preferred method for fabricating the chip is described herein. A variety of substances are provided 15 as the substrate 16. The substrate 16 should be inert to the nanoenergetic material 14 and be able to withstand the heat generated by the flame front. Glass is a particularly preferred substrate 16. Other preferred substrates 16 include silicon, perforated glass, Lexan and polymers. The term "substrate" is not intended to be limited to a single supporting object, even though the singular form of the term is used. One or more supporting materials can form the substrate 16.

Prior to installation of any of the chip 10 components, the substrate 16 should be cleaned to remove impurities that may affect the preparation of the apparatus or the properties of the nanoenergetic material. When glass is used as the substrate 16 material, it is preferably cleaned with a corrosive acid solution such as Aqua Regia (a combination of concentrated sulfuric acid and concentrated nitric acid) or Piranha solution (a combination of concentrated sulfuric acid and hydrogen peroxide) to remove metals and organic contaminants. Residual acids or sulfates are preferably removed by rinsing the substrate 16 under running distilled water. Cleaned substrates 16 are preferably dried at suitable temperatures and pressures. Glass is suitably dried above 100° C., preferably at about 105° C. for about 15 minutes.

A pattern for and the heater 12 mounting is laid down on the substrate 16 using well-known masking techniques. In selecting the placement of the electrode pattern, consideration must be made to allow sufficient space on the substrate 16 to create a sufficiently large sample of the nanoenergetic material 14 to achieve its purpose. If the chip 10 is being designed as a test apparatus for burn rates, there must be sufficient space on the chip 10 to make a path of nanoenergetic material 14 sufficient in length to obtain an accurate measurement of the time for the flame to travel the length of the test path.

Optionally, one or more detectors 22 are laid down at the same time as the heater 20 in those embodiments where it is advantageous to detect passage of the moving flame front at one or more points on the chip 10. Preferably, the detector 22 is a time-varying resistance detector. The pattern for the detector 22 is suitably part of the pattern for the heater 20. Addition of the detector is useful in applications where the chip 10 is used to test the flame propagation rate or in any situation where it is desirable to know when the flame passes a certain location on the chip 10.

Figure 2:
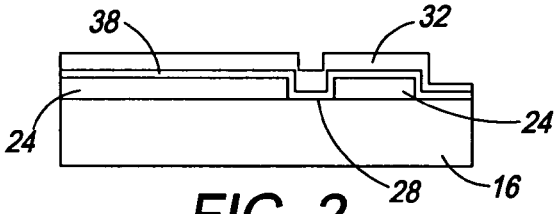
FIG. 2 is a side view of the substrate after sputter coating of titanium and platinum layers.
Figure 3:
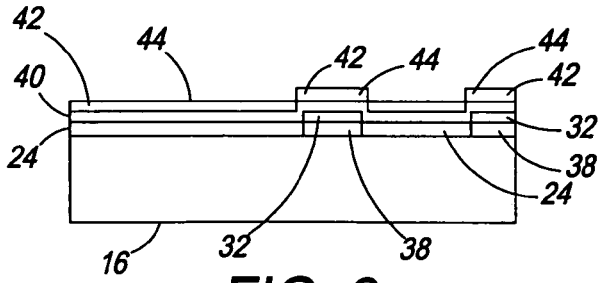
FIG. 3 is a side view of the substrate after it has been spin coated with the nanoenergetic material.
Figure 4:
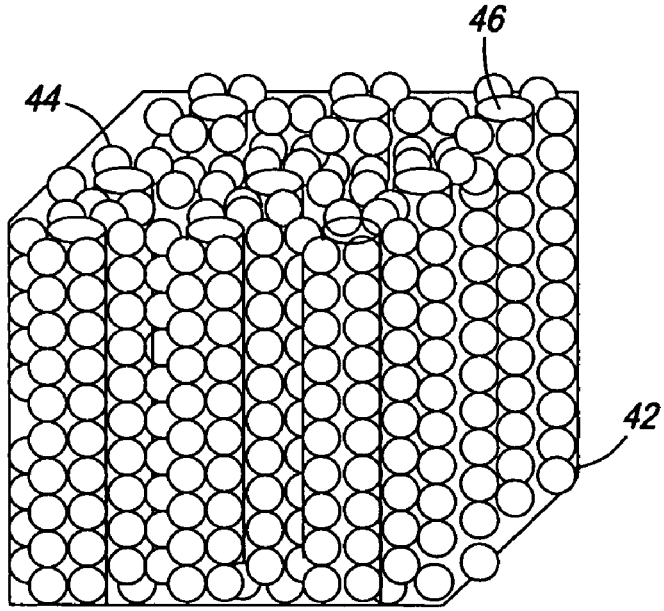
FIG. 4 is a schematic view of a nanorod.
Figure 5:
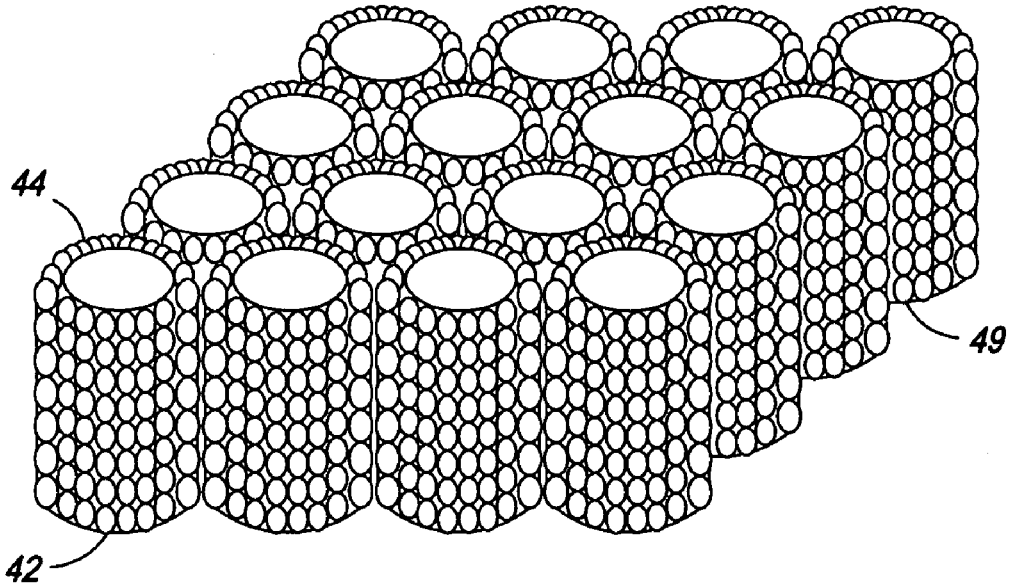
FIG. 5 is a schematic view of a nanowell.
Figure 6:
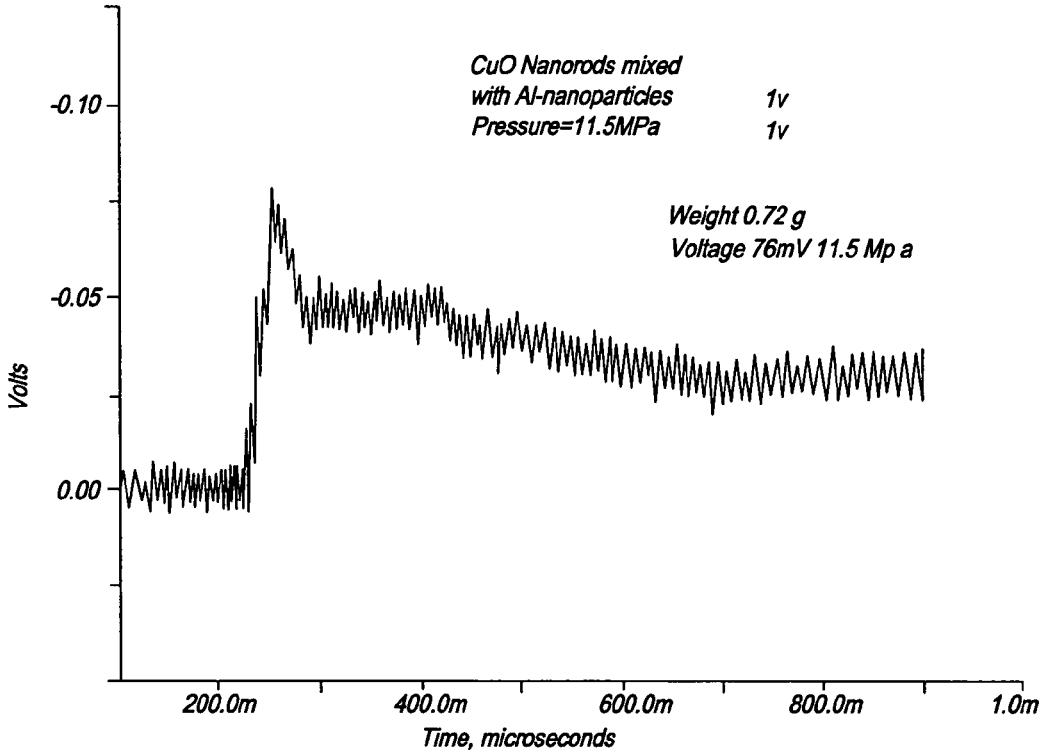
FIG. 6 is a graph of pressure over time during combustion of CuO nanorods mixed with Aluminum nanoparticles.
Figure 8:
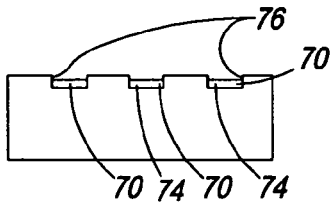
FIG. 8 is a side view of a substrate with microchannels.
Figure 9:
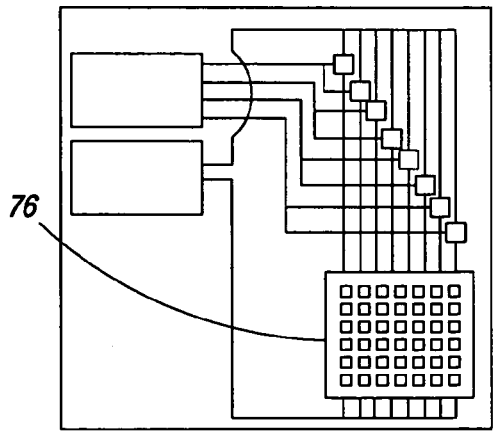
FIG. 9 is a schematic drawing of a igniter array.
Figure 7:
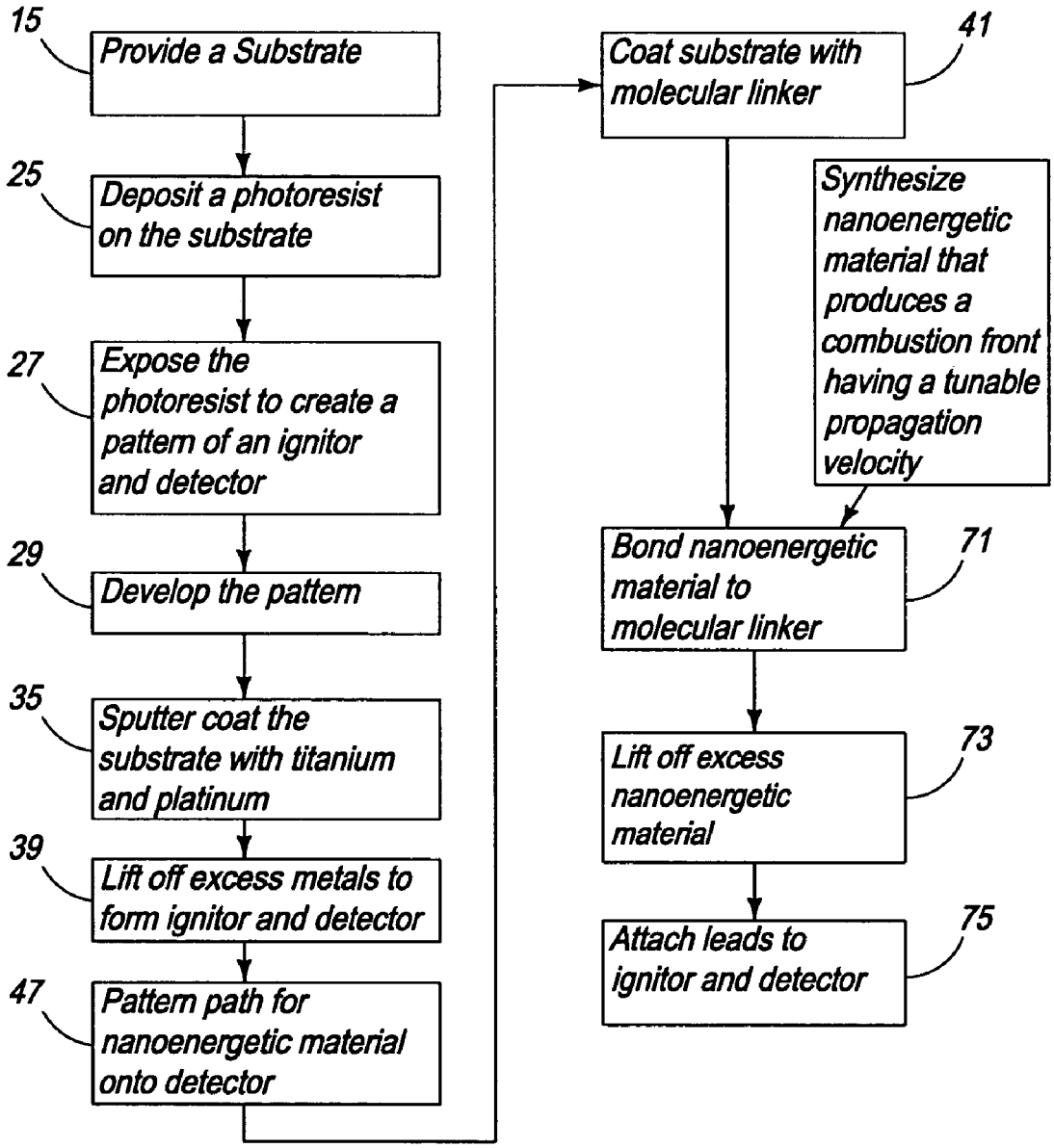
FIG. 7 is a block diagram of the process of making a chip for igniting nanoenergetic materials.

In at least one embodiment, the heater 20 and optional detector 22 pattern is transferred by any known method, preferably using a lithography process. Lithography, in the context of building integrated circuits such as DRAMs and microprocessors, is a highly specialized process used to put detailed patterns onto substrates. Referring to FIG. 2, an image containing the desired pattern, such as a mask, is projected onto the substrate 16, which is coated by a thin layer of a photosensitive resist 24. When using a positive resist, the bright parts of the image pattern allow chemical reactions which cause the resist 24 material to become soluble. This allows the bright parts of the pattern to dissolve away in a developer liquid, whereas the dark portions of the image remain insoluble. A negative resist allows the dark portions of the image to dissolve and the bright portion of the pattern to become insoluble.

Referring to FIG. 21, the photoresist 24 is coated 25 onto the clean substrate 16. Any photoresist, either a positive resist or a negative resist is useful. Preferred photoresists include S1813 (Shipley Company, Marlborough, Mass.), and SU8 photoepoxy resist (Microchem Inc., Woburn, Mass.). Preferably, the photoresist is spin-coated by dispensing the solution over the substrate surface and rapidly spinning the substrate until the excess resist is removed and the substrate is dry. Most spin-coating processes are conducted at final spin speeds of 3000-7000 rpm for a duration of 20-30 seconds. Following spin-drying, the substrate is optionally oven dried at 110° C. for about 7-8 minutes. After drying, the mask is placed over the photoresist 24 and it is exposed to light. The brightness of the light source and the duration of the exposure are determined by the specific photoresist 24 that is selected.

If the positive resist 24 is used, the mask is preferably a transparency onto which the desired features are printed in black at a resolution of about 3200×3200. The transparency mask is then used to transfer the design for the igniter and the resistance-temperature detector onto the substrate. The igniter 12 is selected on the basis of a resistive heating design. Preferred igniters 12 include platinum resistance heaters but other metal resistance heaters can also be used. Enough energy must be supplied by the igniter to cause the nanoenergetic material 14 to burn. Another criteria that is considered is the physical size of the igniter 12, which may vary by application. Some applications require the use of a very small apparatus, which in turn requires the use of an igniter 12 that fits on the substrate 16 and allows space for placement of the remaining components.

Transparent areas on the mask allow passage of the light, exposing 27 the photoresist 24 in those areas to the photoresist to debond from the substrate 16. The pattern 28 is permanently transferred into the substrate 16, for example by a chemical etchant that etches everywhere that is not protected by the resist. Etching removes portions of the substrate 16, leaving wells or depressions in the substrate. The de-bonding 29 photoresist 24 is wet-etched from the substrate 16 with a developer solution. An aqueous tetramethylammonium hydroxide solution, such as Microposit developer MF-321 (Rohm and Hass, MA) is the preferred developer. Other methods of permanently transferring the pattern include metal film etching and shadow masking.

After development, the resist 24 forms the stenciled pattern 28 across the wafer surface which accurately matches the desired pattern. The substrate 16 is thoroughly washed with distilled water to remove impurities. Following washing, the patterned substrate (not shown) is dried in an appropriate manner.

The patterned substrate is next coated with a conductor 32 to form the heater mounting 36. Sputter coating 35 is a preferred method of coating the substrate 16. This technique is well known for increasing the electrical conductivity of a sample, such as samples to be used in a scanning electron microscope. Platinum is the preferred conductor 32 and is preferably sputter coated onto the substrate 16. The thickness of the conductor 32 film is preferably from about 100 nm to about 200 nm. Other well known methods of transferring the pattern to the substrate are also useful. For example, the platinum film can also be patterned using a chromium mask and plasma etching processes.

In preferred embodiments, an adhesive metal 38 is coated onto the substrate 16 prior to coating with the conductor 32 for improved adhesion of the platinum film. Preferably, the adhesive metal 38 is titanium that is sputter coated onto the substrate. For the preferred glass substrate 16, a 20 nm titanium film is sufficient to securely hold a platinum conductor 32 in place.

After coating of the conductor 32, the photoresist is lifted 39 from the uncovered substrate 16 surface by ultrasonication in acetone in a sonicator. The preferred sonicator is a Cole-Parmer Model 8839 sonicator (Cole-Parmer Instrument Company, Vernon Hills, Ill.). When the preferred Cole-Parmer sonicator is used, the output sound frequency was in the range of 50-60 Hz. Sonication should continue until the pattern 28 is etched into the substrate, preferably from about 5 min to about 10 min. The substrate is washed and dried in any suitable manner after sonication.

A molecular linker 40 is coated 41 onto the substrate 16 to bind the nanoenergetic material 14 to the substrate surface 16. The linker 40 is able to bond with both a fuel 42 and an oxidizer 44 nanoparticles. Preferably, the binding sites are not random, but are spaced to non-randomly intermix the fuel 42 and oxidizer 44 for good interfacial surface area.

Suitable molecular-linker 40 materials include polyvinyl pyrrolidone, poly(4-vinyl pyridine), poly(2-vinyl pyridine), poly(ethylene imine), carboxylated poly(ethylene imine), cationic poly(ethylene glycol) grafted copolymers, polyaminde, polyether block amide, poly(acrylic acid), cross-linked polystyrene, poly(vinyl alcohol), poly(n-isopropylacrylamide), copolymer of n-acryloxysuccinimide, poly (acrylontrile), fluorinated polyacarylate, poly(acrylamide), polystyrene-poly(4-vinyl)pyridine and polyisoprene-poly(4-vinyl)pyridine. Metal oxide oxidizer 44 (e.g. CuO etc) and metal fuel nanoparticles 42, such as aluminum nanoparticles, are sonicated in alcohol for a time sufficient to achieve homogenous dispersion. The preferred alcohol is 2-propanol, however, the use of other solvents that allow dispersion of the fuel and oxidizer. Amounts of alcohol from about 2.5 ml/g to about 3.7 ml/g of fuel and oxidizer are preferred. A polymer having a "pyridyl" group is a preferred molecular linker 40, and poly(4-vinyl pyridine), available from Aldrich Chemical, (Sigma-Aldrich Co., St. Louis, Mo.). A solution is prepared having a concentration of about 0.0001-0.1% g/100 ml of the molecular linker in 2-propanol and is coated onto the substrate. Any suitable coating method is usable to coat the molecular linker 40 solution, but spin-coating and dip-coating are preferred.

The presence of material other than fuel 44 and oxidizer 42 tends to slow the burn rate of the nanoenergetic material 14. Cross-linking or bonding of the molecular linker 40 with itself makes is difficult or impossible to remove excess polymer and reduces the burn rate. Thus, another preferred feature of the molecular linker 40 is that it does not bond with itself, allowing excess molecular linker polymer 40 to be removed until essentially a monolayer of molecular linker remains.

After the molecular linker 40 is coated onto the substrate 16, it is preferably washed in ethanol, then annealed. If used, annealing takes place at temperatures of about 110° C. to about 160° C. for several hours. When the preferred poly(4-vinyl pyridine) molecular linker 40 is used, annealing takes place at about 120° C. for about 4 hours.

A second mask, including a pattern (not shown) for the nanoenergetic material 14, is prepared and transferred 47 to the substrate 16 using a lithography process as discussed above. The size and shape of the pattern depends upon the end use to which the chip 10 is to be put. If, as in the preferred embodiment, the chip 10 is a diagnostic tool for determining the flame propagation velocity of nanoenergetic materials 14, the pattern is linear, defining a path 48 from the igniter 12 to the detector. Preferably, at least two detection points 50, 52 are included on the path 48, where the detector reacts to movement of the flame front past the detection point 50, 52. One method of detecting passage of the flame front is by a change in the voltage output of the detector as the flame front passes an intersection of the path 48 and the detector.

The path 48 need not be a straight line, but should be sufficiently long that the time taken for the flame to travel from the first detector 30 to the second detection point 32 is measurable within the accuracy of the equipment used. Use of path 48 designs that are lengthy without intersections, and that are compact to fit on a small substrate are commonly used. Such paths 48 generally have a large number of turns and switchbacks to efficiently use the amount of space available on the substrate 16.

Any nanoenergetic materials 14 are suitable for use on the chip 10. Thermites are preferred nanoenergetic materials 14. They include the fuel 44 and the oxidizer 2. The most preferred nanoenergetic materials 14 are specifically shaped particles that fit compactly together and are assembled having high interfacial surface areas that promote a stoichiometric ratio of the fuel 44 and the oxidizer 42 even at the nanoparticle level. Examples of such nanoenergetic materials 14 are described in copending U.S. Ser. No. 11/262,227, entitled "Ordered Nanoenergetic Composites and Synthesis Method", previously incorporated by reference.

A wide variety of fuels 44 are useful in this invention. Where the nanoenergetic particle is a thermite, the preferred fuel 44 is a metal. Preferred metals include aluminum, boron, beryllium, hafnium, lanthanum, lithium, magnesium, neodymium, tantalum, thorium, titanium, yttrium and zirconium. Metals having a relatively low melting temperature are preferred so as to increase the speed at which they burn. The use of two or more metals, either physically mixed or alloyed, is contemplated.

The fuel 44 is optionally formed into a shape, such as a sphere, that allows the fuel 44 to bind compactly with the molecular linker 30. Sonication is the preferred method for shaping the fuel 44 particles. Fuel 40 is placed in isopropanol and positioned within the sonic field. When activated, the sound waves disperse the fuel 44, creating extremely small particles that are often substantially monoparticles comprising a few atoms or molecules of fuel. The high degree of dispersion creates an extremely high fuel 44 surface area. Other shapes, or larger particles, are useful in applications where the extremely fast burn rate is not required.

The oxidizer 42 should be selected to burn rapidly with the chosen fuel 44. The fuel 44 and the oxidizer 42 are chosen to assure that a self-propagating reaction takes place. As long as the fuel 44 has a higher free energy for oxide formation than the oxidizer, an exothermic replacement reaction will spontaneously occur. Preferred oxidizers 42 include copper oxide ($CuO$ or $Cu_2O$), silver oxide ($AgO$ or $Ag_2O$), boron oxide ($B_2O_3$), bismuth oxide ($Bi_2O_3$), cobalt oxide ($CoO$), chromium oxide ($CrO_3$), iron oxide ($Fe_2O_3$), mercuric oxide ($HgO$), iodine oxide ($I_2O_5$), manganese oxide ($MnO_2$), molybdenum oxide ($MoO_3$), niobium oxide ($Nb_2O_5$), nickel oxide ($NiO$ or $Ni_2O_3$), lead oxide ($PbO$ or $PbO_2$), palladium oxide ($PdO$), silicone oxide ($SiO_2$), tin oxide ($SnO$ or $SnO_2$), tantalum oxide ($Ta_2O_5$), titanium dioxide ($TiO_2$), uranium oxide ($U_3O_8$), vanadium oxide ($V_2O_5$) and tungsten oxide ($WO_3$).

Optimally, the amounts of fuel 44 and oxidizer 42 present in the thermite are in a stoichiometric ratio for combustion of the fuel 44 with the oxidizer 42. Preferred ratios of fuel 44 to oxidizer 42 range from about 1.4 to about 1.8.

Preferably, the oxidizer 42 is shaped into a nanorod 46, nanowire 47 or a structure having a nanowell 49. In a preferred embodiment, the oxidizer 42 particle is shaped by formation of a crystalline structure inside a micelle (not shown) of a surfactant. Synthesis of copper oxide nonorods 46, for example, includes grinding copper chloride dihydrate and sodium hydroxide into fine powders, then added to a polyethylene glycol, such as PEG 400 (Alfa Aesar, Ward Hill, Mass.).

The nanorods 46 are preferably synthesized inside and take the shape of the micelles of the polymeric surfactant. Nanowells 49 are voids or openings in an oxidizer structure 42 that can be filled with fuel nanoparticles 44. The nanowells 49 are formed around the exterior of the micelles. Diblock copolymers are known as surfactants having micelles of an appropriate size. Polyethylene glycol, such as PEG 400 by Alfa Aesar is preferred for this task as it has tubular micelles of about 80 nanometers. PEG 400 also produces nanorods 46 of substantially uniform size. As the molecular weight of the polyethylene glycol increases, the diameter of the nanorod 46 changes. Preferably the micelles have an approximate diameter of about 2 nm to about 10 nm. The surfactant is selected by the size of its micelles to produce nanorods 46 of a particular diameter. Addition of water to the surfactant yields a mixture of nanorods 46 of varying length and having a longer average length.

The preferred nanoeneregtic materials 14 have flame propagation velocity in excess of speed of sound in the medium so that a shock wave is generated. The shock wave is useful in applications, such as detonation of explosives, microdetonators, for pulverizing kidney stones in the medical field and various other applications. When the chip 10 is designed as a fuse or detonation device, additional energy is conveyed to the explosive substance being detonated. Different arrangements of the fuel 44 and oxidizer 42 produce different flame propagation rates. As shown in Table 1, burn rates vary widely depending on how the oxidizer 42 and the fuel 44 are positioned. The burn rates of MIC can be tunable by adding different percentages of polymers such as PVP (poly vinyl pyridine) or explosives such as Ammonium Nitrate as shown in table 1. Addition of polymer also increases gas generation. Fast burn rates above 1500 m/sec. produce shock waves without detonation and can be used for initiation of explosives. Slow burn rates below 600 m/sec. with sustained pressures can be used for initiation of pyrotechniques and propellants. Temperatures and pressures are tuned by the same technique. In all cases, nanoparticles are used, minimizing variations in surface area. When oxidizer particles 42 and fuel particles 44 are randomly mixed, relatively lowborn rates are obtained. However, when the oxidizer is formed into nanorods 46 or nanowells 49, burn rates are doubled or tripled. Burn rates measured by on-chip method were verified using conventional approach using an oscilloscope. The burn rates measured by two different techniques are found to be comparable.

TABLE I

Burn rates of various copper oxide based nanocomposites

| Serial Number | Composite | Burn rate, m/s |
|---|---|---|
| 1 | Copper oxide (CuO) nanowells impregnated with Aluminum (Al)-nanoparticles | 2200-2400 |
| 2 | CuO nanorods mixed with Al-nanoparticles | 1500-1800 |
| 3 | CuO nanorods self-assembled with Al-nanoparticles | 1800-2200 |
| 4 | CuO nanorods mixed with 10% ammonium nitrate and Al-nanoparticles | 1900-2100 |
| 5 | CuO nanowire mixed with Al-nanoparticles | 1900 |
| 6 | CuO nanoparticles mixed with Al-nanoparticles | 550-650 |
| 7 | CuO nanorods mixed with .10% Poly vinyl pyrridine and Al-nanoparticles | 1700-1900 |
| 8 | CuO nanorods mixed with .50% Poly vinyl pyrridine and Al-nanoparticles | 1400-1600 |
| 9 | CuO nanorods mixed with 2% Poly vinyl pyrridine and Al-nanoparticles | 900-1200 |
| 10 | CuO nanorods mixed with 5% Poly vinyl pyrridine and Al-nanoparticles | 300-600 |

The molecular linker-coated substrate 16 is next coated with a photoresist (not shown) using transparency masks to create any of a variety of patterns 64 using any lithographic technique, such as that described above. Hard mask can also be used in place of transparency mask. Shipley S1813 photoresist is a preferred photoresist for this step. Ultrasonication is the preferred method for lifting the photoresist from the remaining substrate 16 surface. The patterned substrate is then preferably rinsed in distilled water and suitably dried.

A mixture 70 of the fuel 44 and the oxidizer 42 is spun coated 71 onto the molecular-linker pattern. Preferably, the mixture 70 is prepared by sonication of the metal nanoparticles 44 and the oxidizer nanoparticles 42 together for about 4-8 hours, or until a homogeneous dispersion of nanoparticles is achieved. The mixture was spun onto the substrate at about 1000 rpm to about 3000 rpm for about 30 sec to about 120 seconds, after which the substrate 66 was dried. Excess nanoenergetic particles are removed 73 by agitation in acetone, followed by sonication of the patterned substrate 66.

After the nanoenergetic material 14 is in position, leads 72 are attached 75 to the igniter 12 if necessary, and any other feature that requires or detects an electrical signal. Additional optional components are added to the chip based on the use to which it is put. If the substrate is made into a diagnostic for the determination of the flame propagation velocity, at least one of the resistance-temperature detectors 22 is added as an element to the mask at the time the igniter is formed.

Optionally the mixture 70 of nanoeneregtic material 14 includes polymer, propellant or explosive nanoparticle 74 contained a microchannel 76 on-chip has shown to produce a shock wave with gas pressure, which will be useful to detonate explosives. The preferred explosive materials include ammonium nitrate, ammonium perchlorate, cellulose nitrate, RDX, TNT, HMX, PBX, and CL-20. The explosive nanoparticles 74 are optional components in the mixture 70 when the chip is configured as a detonation device for high explosives. Burning of the on-chip mixture and production of a shock wave initiates explosive, high energy reactions in high explosives. The length of the path 48 traveled by the flame and shock wave prior to contact with the high explosives is useful as a delay mechanism if desired.

Using the on-chip detonation device, multiple detonation points can be created simultaneously or selectively. It will have the control of explosive or propellant detonation or burning without detonation under hazardous conditions by controlling the temperature and burn rate of thermites. The ability to pattern the initiators 12 using semiconductor processing allows networking and remote sensing of on-chip triggering devices. This device will then be placed into contact with the explosive or propellant by fabricating them inside the enclosures or distributed around the interior walls of a munitions casing and throughout the interior of a compacted high explosive. This distribution will depend on the shape of the final product, pay load of high explosive and the application.

If a controlled ignition of the multiple detonation points is desired, a few of the on-chip initiators 12 could easily be patterned with low to high burn rate thermites. Use of different fuels 44 and oxidizers 42 in the various detonation chips allows the output to be tuned to the desired level by selection of the appropriate cells for detonation. Power generated by combustion of the nanoenergetic materials 14 is similarly controlled by selection of the fuel 44 and oxidizer 42 that provides the appropriate power output. Selection of nanoenergetic materials and appropriate additives allow control voltage from about 3V to about 100V and control of ignition delay from less than a microsecond to a second By using a microcontroller (not shown), the initiators 12 are switched on selectively, for detonation or controlled burning of the nanoenergetic material 14. Ignition could be triggered automatically by using heat sensors in conjunction with the microcontroller. The sensors will continuously monitor the outside temperature to determine if a risk of unwanted detonation exists. On the detection of hazardous conditions the on-chip heaters 12 are triggered to initiate a slow burn off of the nanoenergetic materials 14. Complex systems of chips are designed having arrays 76 of many chips inside a casing that can be programmed by the microcontroller.

EXAMPLE 1

A diagnostic device was made on a glass substrate measuring 1 inch ×3 inches (2.5 cm×7.5 cm). The glass was 0.035 inches thick. It was cleansed for ten minutes with Piranha solution consisting of sulfuric acid ($H_2SO_4$, 98%) and hydrogen peroxide ($H_2O_2$) in a 3:1 ratio. Residual acids and sulfates were removed from the substrate surface by rinsing the substrate in running distilled water. The cleaned substrate was dried at 105° C. for 15 minutes.

Shipley S1813 positive photoresist was spun onto the cleaned glass substrate at 650 rpm for 30 seconds and then oven dried at 110° C. for 7-8 minutes. A black and white transparency mask was printed at a resolution of 3200×3200 dots per inch with patterns for a heater and a time varying resistor. The substrate was then exposed to light in a Kienstein exposure tool for 105 seconds. Passage of light through the clear areas of the transparency allowed the photoresist to de-bond. The de-bonded resist was wet-etched from the substrate using a MICROPOSIT MF-321 developer solution (Rohm and Hass, MA). Areas of the photoresist that were not exposed by the mask remained on the substrate as a protective film. The substrate was washed under running distilled water for 3-5 minutes to remove any remaining de-bonded resist and developer solution. The substrate was then dried at 105° C. for 5 minutes.

The patterned substrate was sputter coated with Titanium at 150 mA current for 1 minute, 50 seconds to deposit a 20 nm film on the substrate. A 130 nm Platinum film was then sputter coated onto the titanium film at 90 mA current for 4 minutes. The photoresist, and any metal film covering it, is lifted off from the substrate surface by ultrasonication in acetone in a Cole-Palmer sonicator (Model 8839) for 5 to 10 min. The substrate was thoroughly washed with distilled water and dried at 105° C. for ten minutes.

Poly(4-vinyl pyridine) (Sigma-Aldrich Co., St. Louis, Mo.) was used as the molecular linker for the nanoparticles. A solution of poly(4-vinyl pyridine) in 2-propanol at a concentration of 0.0001-0.1% g/100 ml was spun coated on the substrate at 1000 revolutions per minute for 30 seconds. The substrate was then dried for 1-2 minutes at room temperature, washed with ethanol to remove excess polymer, then annealed at 120° C. for 4 hours and cooled to room temperature.

Next the substrate was spun coated with S1813 photoresist at 1000 rpm for 30 seconds. A mask containing the pattern for the nanoenergetic material was transferred onto the substrate using the lithographic technique described above. The photoresist was then removed from the remaining surface by ultrasonication in acetone. Washing of the substrate was done in distilled water, followed by drying at 105° C. for ten minutes.

One gram of Alfa Aesar copper oxide (CuO) (Alfa Aeser, Ward Hill, Mass. was placed in a sample vial containing 5 ml of anhydrous 2-propanol and sonicated for 30 minutes. To this mixture was added 0.37 g of aluminum nanopowder (Nanotechnology Inc., TX), then the mixture was again sonicated for 8-10 hours to achieve homogenous dispersion of nanoparticles. The dispersion was then spun onto the substrate at 1000 rpm for 30 seconds. After the substrate was dried for five minutes at 110° C., the unwanted portion of the nanoenergetic material was removed from the substrate using acetone with normal agitation followed by sonication. The wafer was dried at 80° C. for 5-10 minutes to drive off any residual acetone.

EXAMPLE 2

Additional diagnostic apparatuses were made according to the method of Example 1, using different nanoenergetic materials. Bismuth oxide ($Bi_2O_3$) and aluminum nanoparticles were combined in a ratio of 70% oxidizer and 30% fuel, with a total weight of 1.37 g. The powders were dispersed in 5 mL of 2-propanol.

The flame propagation rate of the various nanoenergetic materials made by the process of Example 1 were measured using on-chip method. The chip was fabricated with the heater at one end and the time varying resistor at the other end by sputter coating the platinum film. This chip was coated with uniformly thick layer of nanoenergetic material and the chip was connected across a voltage divider circuit to measure the voltage drop across the time varying resistor detector film. The on-chip heater film was powered by a voltage supply which heated up the energetic material to its ignition point. Current of 2-3 Amps was supplied to the heater when ignition switch was toggled. The excitation voltage applied on the detection circuit was 1.5 volts. As the ignition process is triggered the flame propagates over the time varying resistor film and the change in resistance occurred over a measured time period. This was acquired as a change in voltage response across the time varying resistor film. A data acquisition (DAQ) card (PCI-MIO-16E-1) with a sampling rate of $1.25\times10^6$ samples/sec from National Instruments Inc., TX was used to acquire the voltage drop data with the help of the LabView software (version 7.1, National Instruments Inc). This acquired time period data and the fixed length of time varying resistor film (32 mm), which was spanned over the entire length enabled determination of the burn rates.

EXAMPLE 3

A multi-point Initiator apparatus was made using a microfabrication technique. Borofloat glass microscopic slides from (1×3 in.) were used as the substrate, which were cleaned using the procedure described in Example 1. The substrates were then shadow masked with aluminum (Al) foil in a square pattern of 5×5 mm. After masking the substrates, the sputtering process was performed. First, an interface layer, for adhesion promotion, of Ti was deposited about 10 nm thick. The sputtering system used for the prototypes called for sputtering the Ti at 150 mA for 1 min 50 sec to achieve the desired thickness. Then, the Pt film, about 650 nm thick, was deposited by sputtering 5 cycles at 90 mA for a total time of about 20 min (cycle time of 4 min each). This sputter-coating procedure produced about 130 nm thick films per cycle.

Once the films deposited, the shadow-mask was removed, and discarded. These glass substrates with a thin-film of Ti and Pt-layers were annealed in an oven at 400° C. for 30 min, and were then allowed to cool down slowly to a room temperature. After cooling, the electrical contacts were made by conventional soldering technique. A solder resin flux was placed in a line on the film and thin, nickel coated copper leads were attached, which made contact across the entire width of the heater to maximize contact area. Two leads should have no more than 1.5 mm of space between them to obtain the necessary resistance of 0.5Ω or less. Then the excess resin was rinsed off with acetone followed by deionized water, and then air-dried. The heaters had an average resistance of 0.45Ω±0.5Ω after fabrication and attachment of the leads. This resistance of 0.45Ω±0.5Ω causes the supply, when set to a constant 3V, to deliver 7.5 Amp, for a delivered power of 22 Watts.

A nanoenergetic based dispersion was applied on the initiator and ignited by supplying 3V power to the heater. Burn rate was determined as per the procedure claimed in Example 2. This initiator was configured to control power (from 3V to 30V) and ignition delay from a microsecond to a second.

While a particular embodiment of the chip for igniting a nanoenergetic material has been shown and described, it will be appreciated by those skilled in the art that changes and modifications may be made thereto without departing from the invention in its broader aspects and as set forth in the following claims.

What is claimed is:

1. A chip for igniting nanoenergetic materials, comprising:
a substrate;
an igniter positioned on said substrate; and
a nanoenergetic material coated on said substrate; wherein said chip is configured for use as a diagnostic and further comprises a detector configured to detect passage of a flame front created by combustion of the nanoenergetic material.

2. The chip of claim 1, wherein said nanoenergetic material comprises a nanoparticle and at least one of the group consisting of a nanoparticle, nanorod and a nanowell.

3. The chip of claim 1, wherein said nanoenergetic material comprises a fuel and an oxidizer.

4. The chip of claim 1, wherein said nanoeneregtic material comprises a fuel, an oxidizer, and a molecular linker.

5. The chip of claim 1, wherein said nanoenergetic material comprises a fuel, an oxidizer, and at least one of the group consisting of a propellant and an explosive nanoparticle.

6. The chip of claim 3, wherein said fuel comprises at least one of the group consisting of aluminum, boron, beryllium, hafnium, lanthanum, lithium, magnesium, neodymium, tantalum, thorium, titanium, yttrium and zirconium.

7. The chip of claim 3, wherein said oxidizer comprises at least one of the group consisting of copper oxide, silver oxide, boron oxide, bismuth oxide, cobalt oxide, chromium oxide, iron oxide, mercuric oxide, iodine oxide, manganese oxide, molybdenum oxide, niobium oxide, nickel oxide, lead oxide, palladium oxide, silicone oxide, tin oxide, tantalum oxide, titanium dioxide, uranium oxide, vanadium oxide and tungsten oxide.

8. The chip of claim 4, wherein said molecular linker comprises at least one of the polymers such as poly(vinyl pyridine), poly(methylmethacrylate), poly(vinyl butyral), poly(vinyl chloride), polycarbonate, polystyrene, fluoropolymers, teflon, cerboxyterminated butadiene acrylonitrile, glycidal azide polymer, and poly(vinyl pyrrolidone).

9. The chip of claim 5, wherein said propellant or explosive comprises at least one of the group consisting nanoparticles of ammonium nitrate, ammonium perchlorate, cellulose nitrate, RDX, TNT, HMX, PBX, and CL-20.

10. The chip of claim 1 wherein said flame propagation rate detector comprises a layer of platinum as a time varying resistance detector.

11. The chip of claim 10 wherein said igniter comprises a titanium layer positioned between said substrate and said detector.

12. The chip of claim 1, wherein said chip is configured to detect at least one of the group consisting of the tunable burn rate, shock wave velocity, tunable pressure, and tunable temperature.

13. A multipoint controlled initiator for igniting nanoenergetic materials, comprising:

a casing; and an array of chips; each of said chips comprising a substrate;

an igniter positioned on said substrate;

a nanoenergetic material coated on said substrate; wherein said chip is configured for use in said multipoint controlled initiator.

14. A chip for igniting nanoenergetic materials, comprising:

a substrate;

an igniter positioned on said substrate;

a nanoenergetic material coated on said substrate; wherein said chip is configured to control voltage from about 3V to about 100 V and to control ignition delay from less than a microsecond to a second.

* * * * *